US006106695A

United States Patent [19]

Kalnes et al.

[11] Patent Number: 6,106,695

[45] Date of Patent: Aug. 22, 2000

[54] CATALYTIC HYDROCRACKING PROCESS

[75] Inventors: Tom N. Kalnes, La Grange; Vasant P. Thakkar, Elk Grove Village, both of Ill.

[73] Assignee: UOP LLC, Des Plaines, Ill.

[21] Appl. No.: 09/272,531

[22] Filed: Mar. 22, 1999

[51] Int. Cl.[7] ..... C10G 25/00

[52] U.S. Cl. ..... 208/59; 208/48 R; 208/52 CT; 208/4 A

[58] Field of Search ..... 208/59, 52 CT, 208/49, 48 R

[56] References Cited

U.S. PATENT DOCUMENTS 4,683,052 7/1987 Degnan, Jr. et al. ..... 208/111

5,332,705 7/1994 Huang et al. ..... 502/53

5,523,271 6/1996 De Agudelo et al. ..... 502/74

5,817,589 10/1998 De Agudelo et al. ..... 502/63

*Primary Examiner*—Helane E. Myers

*Attorney, Agent, or Firm*—John G. Tolomei; John G. Cutts, Jr.

[57] ABSTRACT

A process to provide a multiplicity of hydrocracking reaction zones containing hydrocracking catalyst wherein the catalyst is rejuvenated or reactivated while the process unit remains on-stream by the periodic exposure of partially spent catalyst to hot recycle gas containing hydrogen. The hydrocracking catalyst always operates at "near" fresh activity and selectivity thereby resulting in more stable temperature, yield and product quality performance.

7 Claims, 1 Drawing Sheet

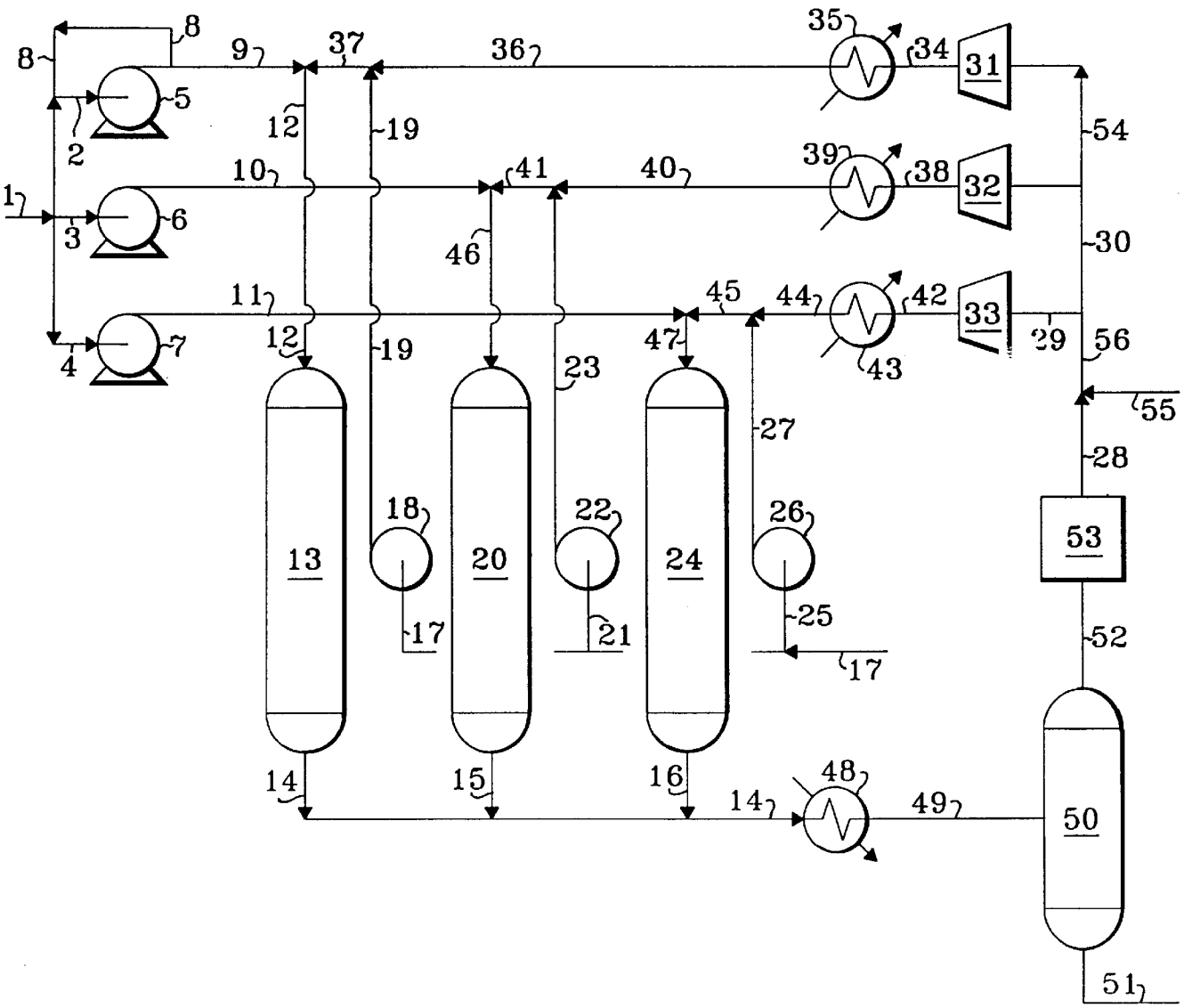
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56

CATALYTIC HYDROCRACKING PROCESS

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical heavy gas oil comprises a substantial portion of hydrocarbon components boiling above about 700° F., usually at least about 50 percent by weight boiling about 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

INFORMATION DISCLOSURE

U.S. Pat. No. 5,817,589 (deAgudelo et al) discloses a process for regenerating a spent hydrogenation catalyst which is deactivated while treating a hydrocarbon feedstock containing diolefins and nitriles until the initial diolefin hydrogenation activity is decreased. The spent hydrogenation catalyst is flushed with an inert gas in a first direction to remove traces of hydrocarbon and then regenerating the flushed catalyst with hydrogen in a second direction substantially opposite to the first direction.

Although a wide variety of process flow schemes, operating conditions and catalysts have been used in commercial activities, there is always a demand for new hydrocracking methods which provide lower costs, higher liquid product yields, and longer on stream operation.

The present invention systematically rejuvenates the hydrocracking catalyst on a frequent basis to obtain start-of-run activity, yields and product quality on a continuous basis without shutdown for catalyst regeneration. Higher average yields and product quality when integrated over time on-stream improve the process economics and demonstrates the unexpected advantages.

BRIEF SUMMARY OF THE INVENTION

The present invention is a catalytic hydrocracking process which provides highly active catalyst operation on a continuous basis without the need for the isolation of hydrocracking reaction zones with block valves or the complete shutdown of the process unit. The process of the present invention provides a multiplicity of hydrocracking reaction zones containing hydrocracking catalyst wherein the catalyst is rejuvenated or reactivated while the process unit remains on stream by the periodic exposure of partially spent catalyst to hot recycle gas containing hydrogen. The hydrocracking catalyst always operates at "near" fresh activity and selectivity thereby resulting in more stable temperature, yield and product quality performance. These advantages are achieved without the use of expensive high pressure shut off valves and their attendant manifolding for the isolation of a hydrocracking catalyst zone during regeneration in accordance with prior art procedures.

In accordance with one embodiment the present invention relates to a catalytic hydrocracking process for the conversion of a hydrocarbonaceous feedstock to lower boiling hydrocarbon compounds which process comprises: (a) passing at least a portion of the hydrocarbonaceous feedstock and hydrogen to a first catalytic hydrocracking zone operating at hydrocracking conditions and containing a hydrocracking catalyst, and recovering a hydrocracking zone effluent therefrom; (b) passing hydrogen at hydrocracking catalyst regeneration conditions to a second catalytic hydrocracking zone containing partially spent hydrocracking catalyst to regenerate the second zone; (c) discontinuing the passing of the hydrocarbonaceous feedstock to the first catalytic hydrocracking zone while continuing the flow of hydrogen to regenerate the hydrocracking catalyst contained therein; and (d) passing at least a portion of the hydrocarbonaceous feedstock to the second catalytic hydrocracking zone operating at hydrocracking conditions and containing regenerated hydrocracking catalyst while continuing the flow of hydrogen and recovering a hydrocracking zone effluent therefrom.

In another embodiment the present invention comprises a catalytic hydrocracking process for the conversion of a hydrocarbonaceous feedstock to lower boiling hydrocarbon compounds which process comprises: (a) passing at least a portion of the hydrocarbonaceous feedstock and hydrogen to a first catalytic hydrocracking zone operating at hydrocracking conditions and containing a hydrocracking catalyst, and recovering a hydrocracking zone effluent therefrom; (b) passing hydrogen at hydrocracking catalyst regeneration conditions to a second catalytic hydrocracking zone containing partially spent hydrocracking catalyst to regenerate the second zone; (c) discontinuing the passing of the hydrocarbonaceous feedstock to the first catalytic hydrocracking zone while continuing the flow of hydrogen to regenerate the hydrocracking catalyst contained therein; (d) passing a regeneration fluid in admixture with the hydrogen during at least a portion of the hydrogen regeneration in step (c); and (e) passing at least a portion of the hydrocarbonaceous feedstock to the second catalytic hydrocracking zone operating at hydrocracking conditions and containing regenerated hydrocracking catalyst while continuing the flow of hydrogen and recovering a hydrocracking zone effluent therefrom.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a hydrocracking process may achieve continued start-of-run activity, yields and product quality by utilizing a valveless swing reactor flowscheme. These advantages enable superior performance and economic results.

The process of the present invention is particularly useful for hydrocracking a hydrocarbon oil containing hydrocarbon and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 550° F., such as atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feed containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F.). The present invention is particularly suited for the production of increased amounts of middle distillate.

At least a portion of the selected feedstock is admixed with a heated hydrogen-rich gaseous stream and the resulting admixture is introduced into a hydrocracking reaction zone operating at hydrocracking conditions and containing hydrocracking catalyst to produce a lower boiling hydrocarbonaceous stream which is subsequently recovered. When the hydrocracking catalyst becomes partially spent as evidenced by less activity and/or a reduction in preferred product selectivity, the introduction of the hydrocarbonaceous feedstock is discontinued while continuing to contact the hydrocracking catalyst with the heated hydrogen-rich gaseous stream at suitable regeneration conditions to recover at least a portion of the original catalyst activity.

In a preferred embodiment, the hot, hydrogen-rich gaseous stream which is used to periodically regenerate the partially deactivated hydrocracking catalyst is admixed with a regeneration fluid. The regeneration fluid is utilized with a hot, hydrogen-rich gaseous stream during at least a portion of the hydrogen regeneration. Suitable regeneration fluids may be selected from the group consisting of steam, hydrogen sulfide and organic sulfide compounds. Suitable hydrocracking catalyst regeneration conditions include a temperature from about 600° F. to about 1000° F., a pressure from about 500 psig to about 2500 psig and a gas hourly space velocity from about 20 $hr^{-1}$ to about 4000 $hr^{-1}$.

The process is able to maintain continuous operation when the feedstock to a regeneration-ready hydrocracking reaction zone is discontinued, the flow of the feedstock is diverted to a newly regenerated hydrocracking reaction zone maintained on stand-by and with a flowing hydrogen-rich gaseous stream thereto. In a process having two hydrocracking reaction zones, for example, the fresh feedstock is alternated between the two zones. While maintaining a flow of a heated hydrogen-rich gas to each of the two zones.

The hydrocracking reaction zones may contain one or more beds of the same or different hydrocracking catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone preferably contains a catalyst which comprises, in general, any crystalline zeolite cracking base upon which is deposited one or more Group VIII or Group VIB metal hydrogenating components.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms($10^{-10}$ meters). It is preferred to employ zeolites having a relatively high silica/alumina mole ratio between about 3 and 12. Suitable zeolites found in nature include, for example, mordenite, stibnite, heulandite, ferrierite, diachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchanging sites which have actually been decationized by further removal of water. Hydrogen or "decationized" Y zeolites of this nature are more particularly described in U.S. Pat. No. 3,130,000.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum and Group VIB., e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) ion order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents, or binders such as alumina, silica gel, silica-alumina cogels, activated clays and the like in proportions ranging between 5 and 90 weight percent. These diluents may be employed as such as they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz). Any other known hydrocracking catalysts may also be employed in the process of the present invention.

The hydrocracking catalysts contemplated for use in the process of the present invention include any support types, sizes and shapes, for example, spheres, cylinders, tri-lobes, quadralobes, rings. The process of the present invention is not limited by the type of hydrocracking catalyst and any suitable known hydrocracking catalyst is contemplated for use therein.

The hydrocracking of the hydrocarbonaceous feedstock in contact with a hydrocracking catalyst is conducted in the presence of hydrogen and preferably at hydrocracking conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 20% to about 60%. More preferably the per pass conversion is in the range from about 30% to about 50%.

The resulting effluent from the on-stream hydrocracking reaction zone contains hydrogen and hydrocracked hydrocarbonaceous components, is preferably combined with regeneration effluent and the resulting admixture is subsequently cooled and separated to provide a hydrogen-rich gas, which is preferably recycled to the hydrocracking reaction zones and hydrocarbon product streams in accordance with known conventional procedures.

DETAILED DESCRIPTION OF THE DRAWING

In the drawing, the process of the present invention is illustrated by means of a simplified schematic flow diagram in which such details as instrumentation, heat-exchange and heat-recovery circuits, separation facilities and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via line 1 and a first portion is passed via line 4 through pump 7 and then via line 11. The first portion of the feed stream is admixed with a hydrogen-rich gaseous stream provided by line 45 and the resulting admixture is passed via line 47 into hydrocracking reaction zone 24. A resulting hydrocracked hydrocarbonaceous stream and hydrogen is removed from hydrocracking reaction zone 24 via lines 16 and 14, cooled in heat exchanger 48 and passed via line 49 into high pressure separator 50. A liquid hydrocarbonaceous stream is removed from high pressure separator 50 via line 51 and recovered. A hydrogen-rich gaseous stream is removed from high pressure separator 50 via line 52, passed through a hydrogen sulfide removal zone 53 and transported via line 28. Fresh make-up hydrogen is introduced via line 55 and the resulting mixture of hydrogen-rich gas is passed by line 56. A second portion of the feed stream is passed via line 3 through pump 6 and then via line 10. The second portion of the feed stream is admixed with a hydrogen-rich gaseous stream provided by line 41 and the resulting admixture is passed via line 46 into hydrocracking reaction zone 20. A resulting hydrocracked hydrocarbonaceous stream and hydrogen is removed from hydrocracking reaction zone via lines 15 and 14, and recovered as described hereinbefore.

When hydrocracking reaction zone 13 is undergoing regeneration, pump 5 is either shut down or a third portion of the feed stream is passed via line 2 through pump 5 and spilled back through lines 9 and 8 with no passage of the feed stream to hydrocracking reaction zone 13. During the regeneration of hydrocracking reaction zone 13, as described above, there is no flow from line 9 and a hot hydrogen-rich gaseous stream maintained at catalyst regeneration conditions is provided via line 37 and introduced into hydrocracking reaction zone 13 via line 12 to regenerate partially deactivated catalyst contained therein. The resulting effluent gas is recovered via line 14. When hydrocracking reaction zone 13 is placed in service, the third portion of the feed stream is passed via line 9 and admixed with a hydrogen-rich gaseous stream provided by line 37. The resulting admixture is then passed via line 12 into hydrocracking reaction zone 13. A resulting hydrocracked hydrocarbonaceous stream and hydrogen is removed from hydrocracking reaction zone 13 via line 14 and recovered as described hereinbefore.

A hydrogen-rich gaseous stream is carried via line 56 and is split three ways to introduce a gaseous stream via lines 54, 30 and 29 to compressors 31, 32 and 33, respectively. Resulting compressed gas streams are removed from compressors 31, 32 and 33 via lines 34, 38 and 42, respectively, and introduced into heat-exchangers 35, 39 and 43. Temperature adjusted gas streams are removed from heat-exchangers 35, 39 and 43 via lines 36, 40 and 44, respectively, for use as described herein.

A regeneration fluid is introduced into the process via line 17 and passed through pump 18, lines 19, 37 and 12 and into hydrocracking reaction zone 13. This regeneration fluid is admixed with a hot, hydrogen-rich gaseous stream provided by line 36 as described hereinabove. When the partially deactivated catalyst in hydrocracking reaction zone 20 is to be regenerated, a regeneration fluid is passed through line 17, line 21, pump 22 and lines 23, 41 and 46, and introduced into hydrocracking reaction zone 20 together with a hot, hydrogen-rich gaseous stream provided by line 40 as described hereinabove. In turn, when the partially deactivated catalyst in hydrocracking reaction zone 24 is to be regenerated, a regeneration fluid is passed through line 17, line 25, pump 26 and lines 27, 45 and 47, and introduced into hydrocracking reaction zone 24 together with a hot, hydrogen-rich gaseous stream provided by line 44 as described before.

EXAMPLE

The process of the present invention is further demonstrated by the following example. This example is, however, not presented to unduly limit the process of this invention, but to illustrate the advantage of the hereinabove-described embodiment.

A pilot plant hydrocracking reactor was loaded with a distillate selective hydrocracking catalyst containing amorphous silica-alumina, zeolite nickel and tungsten. This catalyst had previously accumulated about 800 hours of service at various process conditions where it had accumulated about 10 weight percent carbon and experienced deactivation equivalent to about 18° F. A hydrocracker feedstock having the characteristics presented in Table 1 was processed in the above-described pilot plant hydrocracking reactor at conditions including a pressure of 2250 psig, a temperature of 691° F., a liquid hourly space velocity (LHSV) of 1.2 and a hydrogen gas circulation rate of about 8000 standard cubic feet per barrel (SCFB). The conversion of the feedstock, defined as net cracking of hydrocarbons boiling at greater than 700° F., was 41% when the first regeneration was initiated. The hydrocracking reactor was purged with hydrogen for six hours at a temperature of 691° F. and then purged with hydrogen containing 300 ppm of hydrogen sulfide at 825° F. for about 53 hours. While continuing the hydrogen/hydrogen sulfide purge the reactor was cooled to about 645° F. and then switched back to hydrogen before reintroducing the fresh feed. After the first regeneration, the conversion was found to be 60% at a reactor temperature of 691° F. with a selectivity for middle distillate of 95%. The catalyst was aged by processing the feedstock until the conversion had declined to about 40% and then a second regeneration was performed in the same manner as described hereinabove for the first regeneration. After the second regeneration, the fresh feed was resumed and the conversion was found to be about 58% at a reactor temperature of 691° F. with a selectivity for middle distillate of 95%. After the conversion again dropped off, a third regeneration was performed as described above and the catalyst was then removed from the reactor and analyzed. The catalyst immediately after the third regeneration contained 3.4 weight percent carbon.

From the hereinabove discussion and results, it is apparent that cyclic operation between hydrocracking a hot hydrogen regeneration enhances the production rate of the desired middle distillate product boiling in the range from 300 to 700° F. Analyses of the catalyst before and after the regeneration indicates that the activity restoration is associated with the removal of carbon from the catalyst.

TABLE 1

| HYDROCRACKER FEEDSTOCK ANALYSIS HYDROTREATED VACUUM GAS OIL | |
|---|---|
| Gravity, ° API | 31.4 |
| Distillation, Weight Percent | |
| IBP ° F. | 324 |
| 10 | 622 |
| 30 | 720 |
| 50 | 778 |
| 70 | 836 |
| 90 | 926 |

TABLE 1-continued

| HYDROCRACKER FEEDSTOCK ANALYSIS HYDROTREATED VACUUM GAS OIL | |
|---|---|
| FBP | 1069 |
| Sulfur, wt. ppm | 366 |
| Nitrogen, wt. ppm | 26 |

The foregoing description, drawing and example clearly illustrate the advantages encompassed by the process of the present invention and the benefits to be afforded with the use thereof.

What is claimed:

1. A catalytic hydrocracking process for the continuous conversion of a hydrocarbonaceous feedstock to lower boiling hydrocarbon compounds which process comprises:

(a) passing at least a portion of said hydrocarbonaceous feedstock and hydrogen to a first catalytic hydrocracking zone operating at hydrocracking conditions and containing a hydrocracking catalyst, and recovering a hydrocracking zone effluent therefrom;

(b) passing hydrogen at hydrocracking catalyst regeneration conditions to a second catalytic hydrocracking zone containing partially spent hydrocracking catalyst to regenerate said second zone;

(c) discontinuing the passing of said hydrocarbonaceous feedstock to said first catalytic hydrocracking zone while continuing the flow of hydrogen to regenerate the hydrocracking catalyst contained therein;

(d) passing hydrogen sulfide in admixture with said hydrogen during at least a portion of the hydrogen regeneration in step (c); and (e) passing at least a portion of said hydrocarbonaceous feedstock to said second catalytic hydrocracking zone operating at hydrocracking conditions and containing regenerated hydrocracking catalyst while continuing the flow of hydrogen and recovering a hydrocracking zone effluent therefrom.

2. The process of claim 1 wherein said hydrocracking conditions include a temperature from about 400° F. to about 900° F., a pressure from about 500 psig to about 2500 psig and a liquid hourly space velocity from about 0.1 $hr^{-1}$ to about 15 $hr^{-1}$.

3. The process of claim 1 wherein said hydrocarbonaceous feedstock boils in the range from about 450° F. to about 1050° F.

4. The process of claim 1 wherein said partially spent hydrocracking catalyst is purged with a hot, hydrogen-rich gaseous stream immediately before the regeneration thereof.

5. The process of claim 1 wherein the per pass conversion in the hydrocracking zone is in the range from about 20% to about 60%.

6. The process of claim 1 wherein said hydrocracking effluent is combined with an effluent from step (b) to produce a hydrogen-rich gaseous stream and hydrocracked hydrocarbon components.

7. The process of claim 1 wherein at least a portion of the hydrogen-rich gaseous stream produced in claim 6 is recycled to steps (a), (b) and (d).

* * * * *